United States Patent [19]

Compen et al.

[11] Patent Number: 4,806,823

[45] Date of Patent: Feb. 21, 1989

[54] METHOD OF MANUFACTURING AN ELECTRON BEAM TUBE AND ELECTRON BEAM TUBE THUS MANUFACTURED

[75] Inventors: Johannes M. A. A. Compen; Wilhelmus M. P. Van Kemenade, both of Eindhoven, Netherlands

[73] Assignee: U.S. Philips Corporation, New York, N.Y.

[21] Appl. No.: 109,789

[22] Filed: Oct. 16, 1987

[30] Foreign Application Priority Data

Oct. 29, 1986 [NL] Netherlands ..... 8602717

[51] Int. Cl.[4] ..... H01J 9/20; H01J 29/28

[52] U.S. Cl. ..... 313/479; 427/64; 427/106; 427/122

[58] Field of Search ..... 445/58; 427/64, 106, 427/122; 313/479

[56] References Cited

U.S. PATENT DOCUMENTS

| | | | |
|---|---|---|---|
| 3,473,942 | 10/1969 | Magill et al. | 427/404 |
| 4,041,347 | 8/1977 | Deal et al. | 427/64 |
| 4,092,444 | 5/1978 | Kilichowshi | 427/64 |
| 4,301,041 | 11/1981 | Shah | 427/64 X |

*Primary Examiner*—Kenneth J. Ramsey

*Attorney, Agent, or Firm*—John C. Fox

[57] ABSTRACT

The invention relates to an electron beam tube for displaying color television pictures and to a method of manufacturing same, in which a graphite suspension substantially free from alkali metal ions and comprising colloidal silicon oxide is used for making contact between the color selection electrode and the phosphor pattern on the display window. This suspension enables a method of manufacture which is simpler than the conventional methods.

3 Claims, 3 Drawing Sheets

METHOD OF MANUFACTURING AN ELECTRON BEAM TUBE AND ELECTRON BEAM TUBE THUS MANUFACTURED

BACKGROUND OF THE INVENTION

The invention relates to a method of manufacturing an electron beam tube for displaying television pictures, which tube is provided with a glass envelope having a substantially rectangular display window on which phosphor patterns are present, and a colour selection electrode facing these patterns. More particularly, the invention relates to such a method in which a lacquer layer is provided on the patterns and an aluminium layer is provided on the lacquer layer, whereafter the lacquer layer is removed and the aluminium layer is left on the patterns, and an electrically conducting contact is obtained between the patterns and the colour selection electrode via a strip-shaped electrically conducting graphite layer and the aluminium layer.

A method of the type described in the opening paragraph in known, for example, from U.S. Pat. No. 4,301,041.

In a method of the type described in the opening paragraph, patterns of red, green and blue phosphors are provided on the display window in a conventional manner. A lacquer layer and an aluminium layer are successively provided on these patterns. The aluminium layer is used inter alia to prevent charging of the display window and for reflection of the light emitted by the phosphors.

The lacquer layer is used to establish a satisfactory coating of the phosphor patterns by the aluminium layer. In a thermal treatment after the provision of the aluminium layer, taking place, for example, when the display window and the cone are sealed, the lacquer layer is removed.

A conducting contact must be provided between the colour selection electrode and the aluminium layer. As is common practice, a layer of a graphite suspension in the form of a strip is used for this purpose, one end of which strip is provided on the aluminium layer, and the other end extends as far as, for example, suspension pins of the colour selection electrodes, which pins are sealed on the wall of a raised edge of the display window.

In this respect it is to be noted that the graphite strip is needed because the aluminium film which is provided by vapour deposition does not provide satisfactory contacts with the suspension pins.

However, when the lacquer layer, the aluminium layer and the graphite layer are successively provided and when subsequently the lacquer layer is removed by a thermal treatment, the graphite layer is interrupted because the underlying lacquer layer impedes the adhesion of the graphite layer to the glass wall in areas where the aluminium layer is absent.

Consequently, the lacquer layer must be removed prior to providing the graphite layer. For this purpose, either an additional thermal treatment is required or it is necessary to add solvents dissolving the lacquer layer to the graphite suspension, or the lacquer layer must be removed by another process, for example, a mechanical process.

Providing the graphite layer prior to providing the lacquer layer is no solution because graphite layers of the conventional composition are attacked by solvents used for the lacquer layer.

It is an object of the invention to obviate the described problem at least to a considerable extent. The invention is based inter alia on the recognition that a graphite layer having a suitable composition can contribute to realising this object.

SUMMARY OF THE INVENTION

According to the invention the method described in the opening paragraph is therefore characterized in that the strip-shaped graphite layer is substantially free from alkali metal ions and comprises at least 5% by weight of colloidal silicon oxide, and in that the steps of the method are performed in a sequence such that the lacquer layer is provided on the graphite layer and the aluminium layer is provided on the lacquer layer. Graphite layers of the composition mentioned above are not attacked by lacquer layers. The method according to the invention has the advantages that it does not necessitate an additional thermal treatment for the removal of the lacquer layer, that it is not necessary to add a solvent for the lacquer layer to the graphite suspension, and that the lacquer layer need not be removed in another separate step.

The invention also relates to an electron beam tube for displaying television pictures, which tube is provided with a glass envelope having a substantially rectangular display window on which a pattern of phosphor elements are present, and a colour selection electrode facing the pattern, the pattern and the colour selection electrode being connecting together in an electrically conducting manner by an aluminium layer and a strip-shaped electrically conducting graphite layer. A tube of this type can be manufactured in a very simple manner, namely without additional steps, when the graphite layer in the tube according to the invention is substantially free from alkali metal ions and comprises at least 5% by weight of colloidal silicon oxide and is present at the area of the aluminium layer between the glass envelope and the aluminium layer. The expression "substantially free from alkali metal ions" is understood to mean that at most approximately 1% by weight of oxides of alkali metals is present in the colloidal silicon oxide.

The colour selection electrode is preferably secured to suspension pins sealed in a raised edge of the display window and the strip-shaped graphite layer extends from the suspension pins to the aluminium layer.

BRIEF DESCRIPTION OF THE DRAWINGS

The invention will now be described in greater detail with reference to the accompanying drawing and the presently preferred embodiments. In the drawing.

DESCRIPTION OF THE PREFERRED EMBODIMENTS

Figure 1:
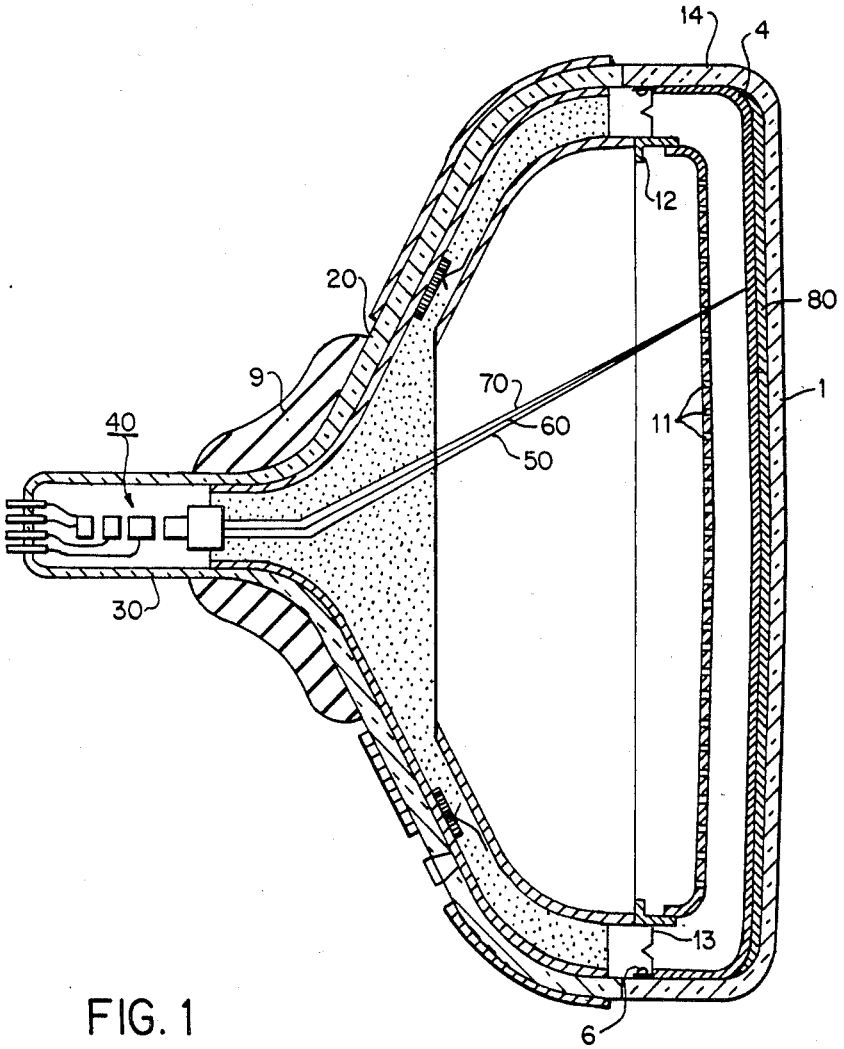
FIG. 1 Prior Art
FIG. 1 is a diagrammatic cross-section of an electron tube in accordance with the invention.
Figure 2:
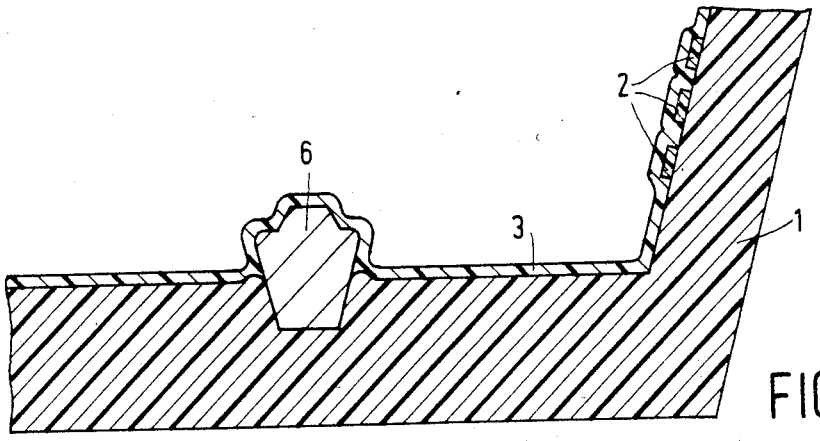
FIG. 2 is a diagrammatic cross-section of a part of an electron beam tube in a stage of manufacture by conventional methods.

The electron beam tube shown in a horizontal sectional view in FIG. 1 contains an envelope consisting of a substantially rectangular display window 1, a cone part 20 and a neck 30. In the neck 30 there is provided an electrode system 40 having three electron guns for generating three electron beams 50, 60 and 70. The electron beams are generated in one plane, the so-called in-line plane (in this case the plane of the drawing), and they are focused on a picture screen 80 which is provided on the inside of the display window 1, which picture screen consists of a large number of phosphor elements which are coated with an aluminium layer 4 and which emit red, green and blue light. The phosphor elements may be in the form of, for example, stripes or dots. By way of example, the invention will be described in terms of stripe-like elements whose longitudinal direction is perpendicular to the in-line plane. The electron beams 50, 60 and 70 are deflected across the picture screen 80 by means of a number of deflection coils 9 which are coaxially arranged about the axis of the tube, the beams passing a color selection electrode 10 consisting of a metal plate with rectangular apertures 11, the longitudinal direction of which is parallel to the phosphor elements of the picture screen 80. The three electron beams 50, 60 and 70 pass through the apertures 11 at small angles relative to one another and, consequently, are incident on only one colour each. The colour selection electrode 10 is secured to a framework 12, which in turn is suspended in the cathode ray tube from upright edge 8 of the display window 1 by suspension means 13 secured to suspension pins 6 sealed in the upright edge 8.

Figure 5:
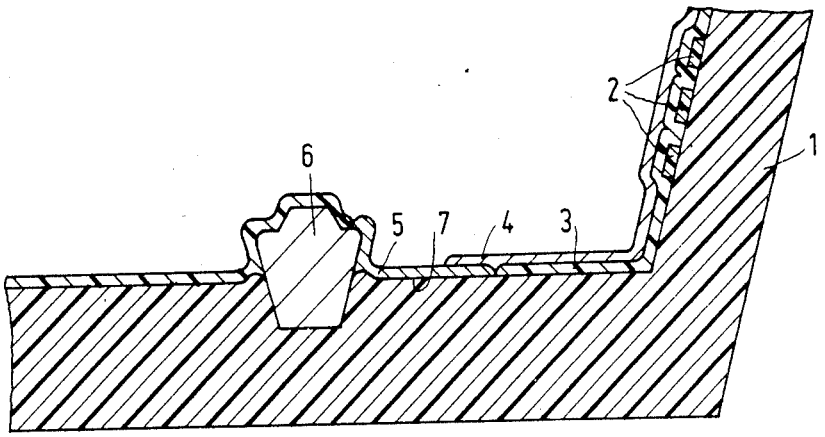
Figure 6:
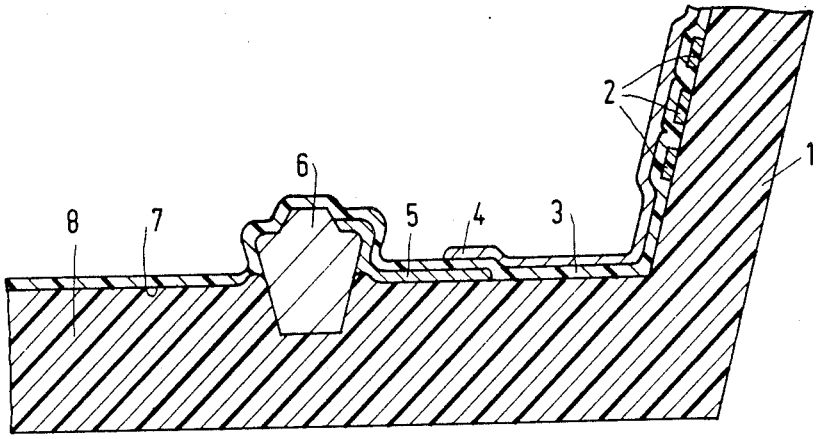
FIG. 6 is a diagrammatic cross-section of a part of an electron tube in a stage of manufacture by the method according to the invention.

One embodiment of the invention relates to a method of manufacturing an electron beam tube for displaying television pictures, which tube is provided with a glass envelope having a substantially rectangular display window 1 (see FIG. 1). Phosphor elements 2 are present on the display window 1 and a colour selection electrode (now shown) faces these patterns 2. A lacquer layer 3 is provided on the patterns 2 and an aluminium layer 4 is provided on the lacquer layer 3 (see FIGS. 3 and 5) whereafter the lacquer layer 3 is removed and the aluminium layer 4 is left on the patterns 2.

An electrically conducting contact between the patterns 2 and the colour selection electrode is obtained via a strip-shaped electrically conducting graphite layer 5 (FIGS. 3, 4 and 5) and the aluminium layer 4, more specifically the graphite layer 5 at least partly covers sealed-in metal suspension pins 6 of the colour selection electrode on the one hand and contacts the aluminium layer 4 on the other hand.

Figure 3:
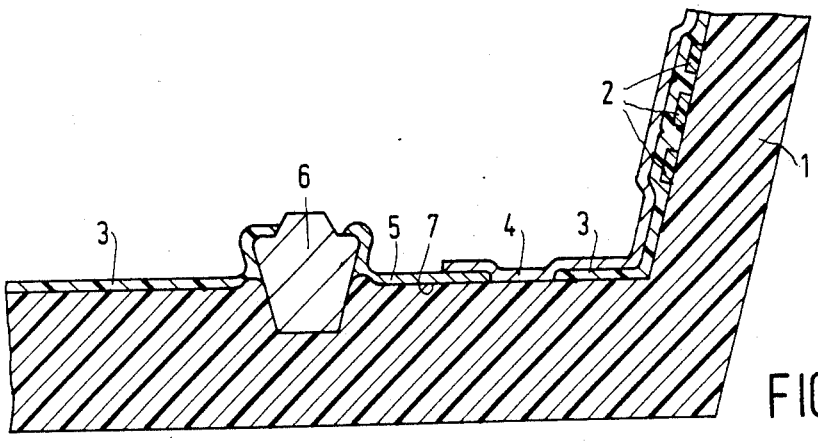
FIGS. 3, 4 and 5 are diagrammatic cross-sections of a part of an electron tube in parallel successive stages of manufacture by conventional methods.
Figure 4:
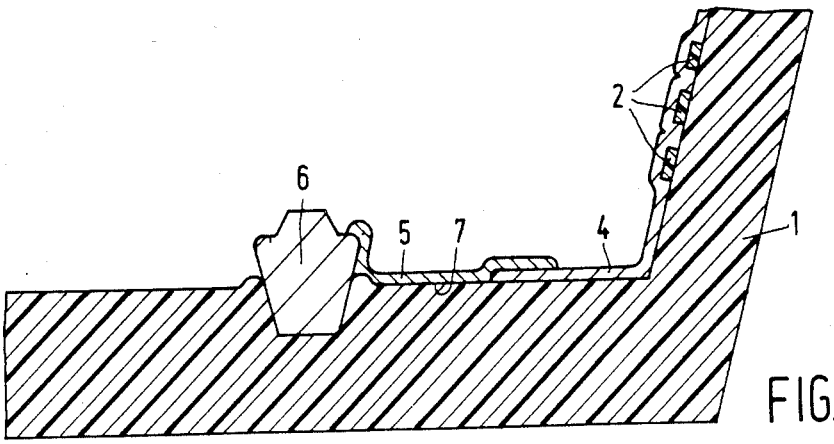

In conventional methods (see FIGS 3, 4 and 5) problems present themselves in the form of necessary additional steps. The lacquer layer 3 is provided from a solution over a large surface area. The aluminium layer 4 is provided by vapour deposition on a part of the lacquer layer 3. If the graphite layer 5 on suspension pins 6 is provided partly on the lacquer layer 3, the graphite layer 5 will not satisfactorily adhere to the glass wall 7 after the lacquer layer 3 is removed. In conventional methods the lacquer layer 3 is therefore removed at the area where the graphite layer 5 is provided. This is done by a mechanical process (see FIG. 3) in which the areas which are coated with the layers 3 and 5 are separated from each other, or by thermal treatment (see FIG. 4) so that the layer 3 is removed before the layer 5 is provided, or by addition of a solvent for the layer 3 to the layer 5, with layer 5 and layer 3 adjoining each other temporarily (see FIG. 5). These additional steps are obviated in the method according to the invention in that the strip-shaped graphite layer 5 is substantially free from alkali metal ions and comprises at least 5% by weight of colloidal silicon oxide and in that the lacquer layer 3 is provided on the graphite layer 5 and the aluminium layer 4 is provided on the lacquer layer 6 (FIG. 3).

An electron beam tube of this type can be manufactured without the said additional steps, since the composition of the graphite layer 5 prevents the risk of attack of this layer by solvents of the lacquer layer 3. Thus, an electron beam tube for displaying television pictures is obtained which is provided with a glass envelope having a substantially rectangular display window 1 on which a pattern of phosphor elements 2 are present, and a colour selection electrode facing these elements 2, which elements 2 and the colour selection electrode are connected together in an electrically conducting manner by means of an aluminium layer 4 and an electrically conducting graphite layer 5.

According to the invention the graphite layer 5 is substantially free from alkali metal ions and comprises at least 5% by weight of colloidal silicon oxide, whilst the graphite layer is present at the area of the aluminium layer 4 between the glass envelope 1 and the aluminium layer 4. The colour selection electrode is preferably secured to suspension pins 6 sealed in the upright edge 8 of the display window 1 and the strip-shaped graphite layer 5 extends from the suspension pins 6 to the aluminium layer 4. The elements 2 are provided in a conventional manner.

Typically, the graphite layer is 3 to 50 μm thick and is provided by brushing etc. of an aqueous suspension comprising 20% by weight of graphite, 5% by weight of a conventional bulk colloid and 10% by weight of colloidal $SiO_2$ having a particle size of $<25$ nm and a specific surface area of $>100$ $m^2/g$. The lacquer layer 3 is 0.1–1.0 μm, for example, 0.4 μm thick and comprises acrylate resin and is provided from a solution of the said resin in toluene or from and aqueous emulsion of the said resin. The aluminium layer is 0.2–0.3 μm thick and is vapour deposited. The lacquer layer is removed during the thermal treatment which is required for sealing the display window to its associated cone, with the display window being at a peak temperature of 440° C. for 45 minutes.

The invention is not limited to the embodiment described, but many variations are possible within the scope of the invention.

What is claimed is:

1. A method of manufacturing an electron beam tube for displaying television pictures, which tube is provided with a glass envelope having a substantially rectangular display window on which a pattern of phosphor elements is present, and a colour selection electrode facing these elements, the method comprising:

(a) providing a lacquer layer on the pattern;

(b) providing an aluminium layer on the lacquer layer;

(c) removing the lacquer layer, leaving the aluminium layer on the pattern;

(d) providing a strip-shaped electrically conducting graphite layer between the color selection electrode and the aluminium layer, to obtain an electrically conducting contact between the pattern and the colour selection electrode, characterized in that the strip-shaped graphite layer is substantially free from alkali metal ions and comprises at least 5% by weight of colloidal silicon oxide, and in that the lacquer layer is provided on the graphite layer and the aluminium layer is provided on the lacquer layer.

2. An electron beam tube for displaying television pictures, which tube is provided with a glass envelope having a substantially rectangular display window on which a pattern of phosphor elements is present, and a colour selection electrode facing the pattern, the pattern and the colour selection electrode being connected together in an electrically conducting manner by an aluminium layer and a strip-shaped electrically conducting graphite layer, characterized in that the graphite layer is substantially free from alkali metal ions and comprises at least 5% by weight of colloidal silicon oxide, and is present at the area of the aluminium layer between the glass envelope and the aluminium layer.

3. An electron beam tube as claimed in claim 2, characterized in that the colour selection electrode is secured to suspension pins sealed in an upright edge of the display window, and the strip-shaped graphite layer extends from the suspension pins to the aluminium layer.

* * * * *